US006332726B2

(12) United States Patent
Yamamoto et al.

(10) Patent No.: US 6,332,726 B2
(45) **Date of Patent: *Dec. 25, 2001**

(54) CONTAINER PROVIDED APPLICATOR

(75) Inventors: Yoshinori Yamamoto; Mitsugu Iwatsubo; Kazunori Nobumoto, all of Tokyo (JP)

(73) Assignee: Kao Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/485,708

(22) PCT Filed: Jun. 15, 1999

(86) PCT No.: PCT/JP99/03172

§ 371 Date: Feb. 29, 2000

§ 102(e) Date: Feb. 29, 2000

(87) PCT Pub. No.: WO00/00058

PCT Pub. Date: Jan. 6, 2000

(30) Foreign Application Priority Data

Jun. 30, 1998 (JP) ..... 10/198131
Jun. 30, 1998 (JP) ..... 10/198132

(51) Int. Cl.[7] ..... B43M 11/06
(52) U.S. Cl. ..... 401/183; 401/186; 401/187
(58) Field of Search ..... 401/183, 186, 401/187, 270, 276, 278

(56) References Cited

U.S. PATENT DOCUMENTS 863,260 * 8/1907 Butterfield ..... 401/183
991,798 * 5/1911 Orthwein ..... 401/183

FOREIGN PATENT DOCUMENTS

06345069 * 12/1994 (JP) .
6 345 069 * 12/1994 (JP) .
09058750 A * 3/1997 (JP) .
09077137 A * 3/1997 (JP) .
9 058 750 * 3/1997 (JP) .
9 77136 * 3/1997 (JP) .
9 77137 * 3/1997 (JP) .
56-19923 * 7/1997 (JP) .
9-175566 * 7/1997 (JP) .
9-77136 * 9/1997 (JP) .
10 165 222 * 6/1998 (JP) .
10165222 A * 6/1998 (JP) .

* cited by examiner

*Primary Examiner*—David Walczak
(74) *Attorney, Agent, or Firm*—Oblon, Spivak, McClelland, Maier & Neustadt, P.C.

(57) ABSTRACT

A container with an applicator has a container main body, which is composed of a flexible outer layer and an inner layer laminated on the outer layer so as to be freely peeled therefrom. The container futher is provided with an air introducing hole on the outer layer and a discharge opening connected with the inner layer, and an applicator provided at the discharge opening of the container main body.

8 Claims, 4 Drawing Sheets

CONTAINER PROVIDED APPLICATOR

BACKGROUND OF THE INVENTION

1. Field of the Invention

The present invention relates to a container with an applicator for applying agent such as hair dye and hair agent.

2. Discussion of the Background

Conventionally, as a container with an applicator, Japanese Utility Model Application Publication No. 56-19923 discloses a container in which a dip tube is disposed inside a flexible container main body and an applicator is disposed at a discharge opening connected with the dip tube.

However, the conventional technique has the following problems (1)–(2).

(1) Since the dip tube has an opening in the vicinity of a bottom portion on a vertical lower portion of the container main body, when applying agent is discharged from the applicator, the agent is pushed to be discharged from the dip tube towards the applicator. As a result, it is necessary that the opening of the dip tube is positioned in the vertical lower portion of the container main body at the time of the discharge of the applying agent, and thus the applying agent can be discharged only in a state that the container stands regularly.

(2) The inside of the flexible container main body is pressurized by squeeze deformation, and the applying agent is discharged through the dip tube positioned in the vertical lower position of the container main body. Thereafter, the container main body absorbs air so that deflection due to the squeeze deformation is restored, and is prepared for a next discharge. For this reason, air in the container main body increases according to a decrease of the applying agent, and when the agent is discharged, the agent is dispersed to a range out of an objective portion to be applied due to the inclusion of air. As a result, the agent is in danger of entering eyes.

SUMMARY OF THE INVENTION

It is an object of the present invention to be capable of discharging an applying agent in any posture of a container with an applicator and to prevent dispersion of the applying agent due to inclusion of air even when a residual amount of the applying agent becomes small.

To achieve the above and other objects, a container with an applicator of the present invention is constituted so as to have a container main body, which is composed of a flexible outer layer and an inner layer laminated on the outer layer so as to be freely peeled therefrom The container is further provided with an air introducing hole on the outer layer and a discharge opening connected with the inner layer; and an applicator connected with the discharge opening of the container main body.

DESCRIPTION OF THE PREFERRED EMBODIMENTS

Figure 1:
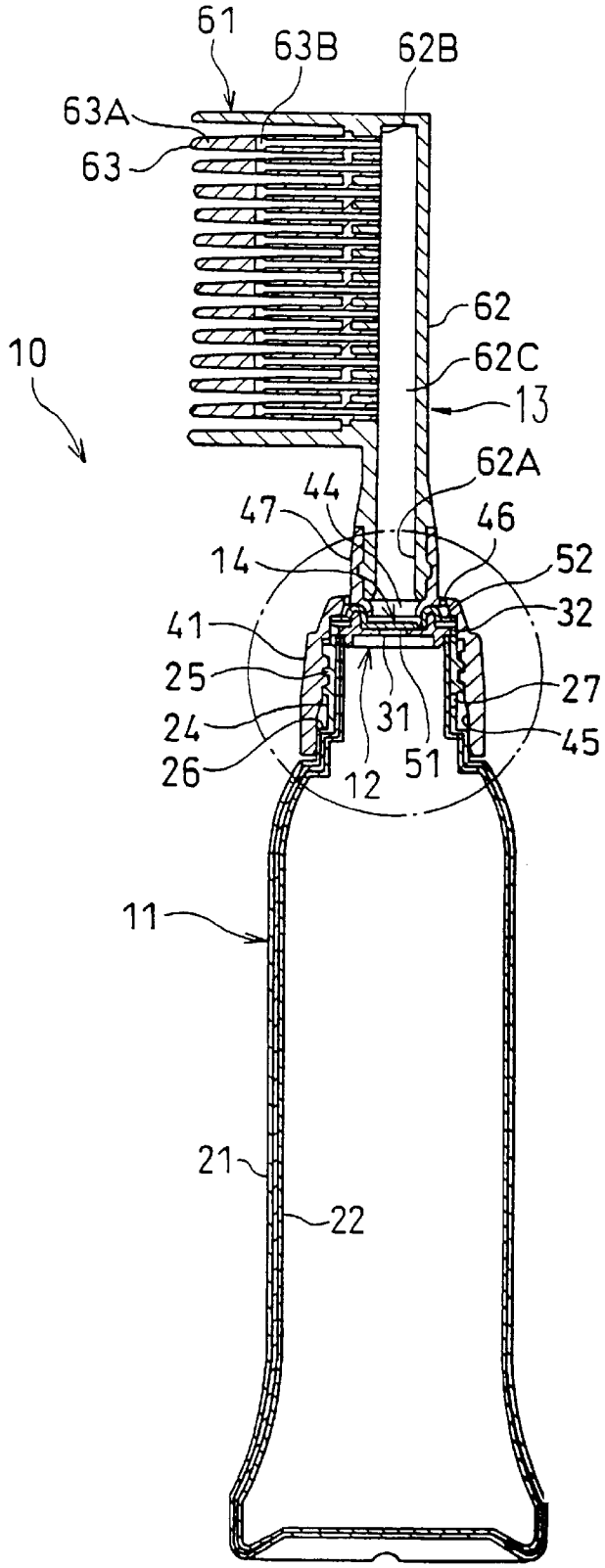
FIG. 1 is a schematic diagram showing a container with an applicator.

As shown in FIG. 1, a squeeze container 10 with an applicator is an assembly body of a container main body 11 and an applicator 61. The container main body 11 has an inside plug 12, a cap 13 and a valve body 14.

Figure 2:
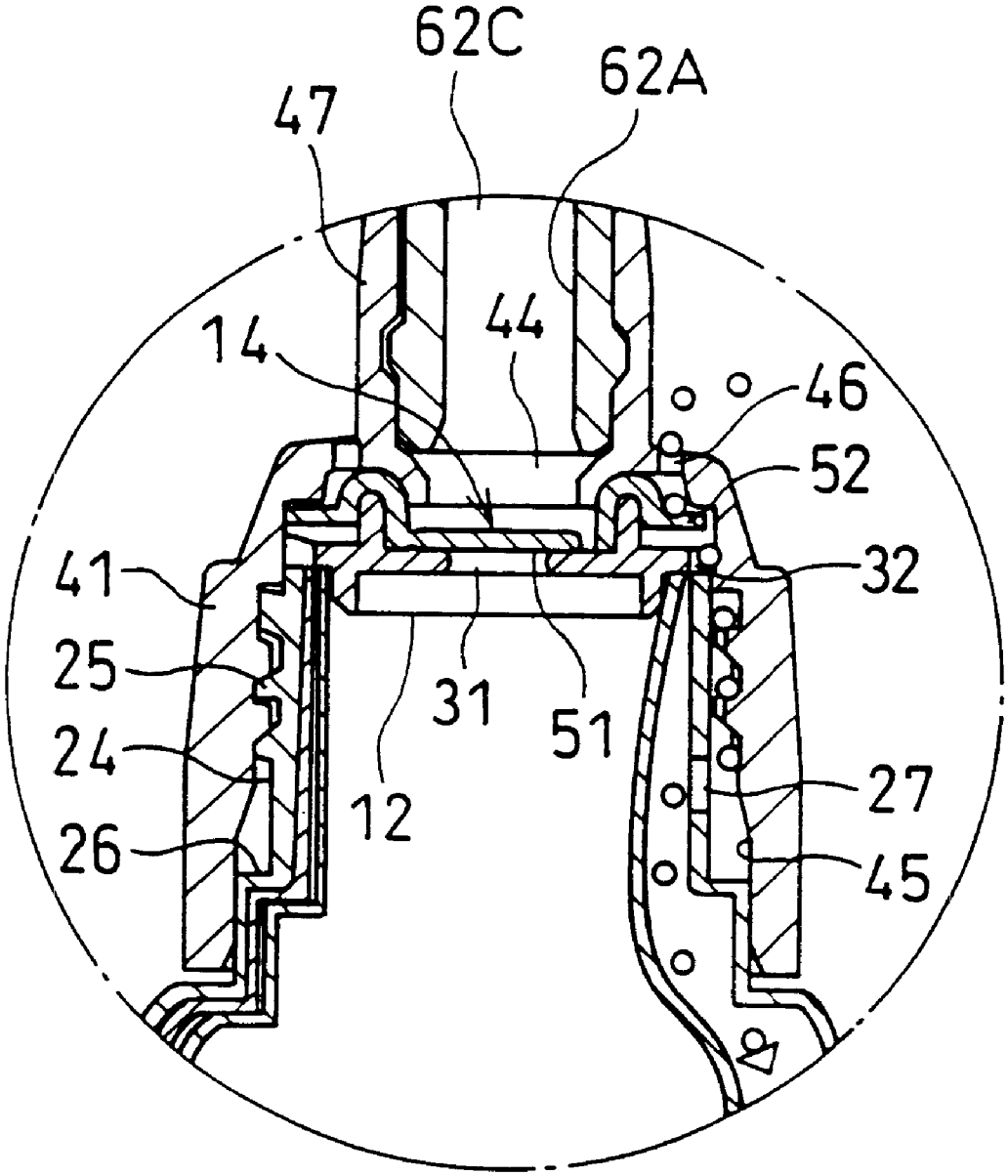
FIG. 2 is an enlarged diagram of a main section of FIG. 1.

As shown in FIGS. 1 and 2, the container main body 11 is composed of an outer layer 21 and an inner layer 22 which is laminated on the outer layer 21 so as to be freely peeled therefrom. The container main body 11 is manufactured in such a manner that a laminated parison of the outer layer 21 and the inner layer 22 is blow-formed. The outer layer 21 is deformed by squeezing and is restored when the squeezing is released, and the outer layer 21 maintains an appearance shape of the container main body 11. The inner layer 22 is a film-back liner which is freely peeled from the outer layer 21 and is deformed.

The container main body 11 has a screw portion 25 for screwing into a cap cylinder 41 which holds the valve body 14 and the inside plug 12 on an outer circumference of an opening portion 24, and a fitting shoulder portion 26 to which a lower end inner circumferential portion of the cap cylinder 41 of the cap 13 is joined. The container main body 11 has an air introducing hole 27 on the outer layer 21 at the opening portion 24, and air is introduced between the outer layer 21 and the inner layer 22 when the outer layer 21 is restored so that the appearance shape of the container main body 11 is maintained and the peeling of the inner layer 22 can proceed.

Since the inside plug 12 is fitted into the cap cylinder 41 by means of the valve body 14, the empty container main body 11 which runs out of the applying agent can be replaced by a new one. Moreover, the inside plug 12 has a discharge passage 31 which is connected with the inside of the container main body 11, and an intake passage 32 which is connected with the air introducing hole 27 via an air inlet passage 45, mentioned later, between the outer circumferential surface of the opening portion 24 and the inner circumferential surface of the cap cylinder 41 of the cap 13 fitted into the opening portion 24.

The cap 13 includes the cap cylinder 41, into which the screw portion 25 of the opening portion 24 of the container main body 11 is screwed, and the applicator 61 which is mounted to a mounting portion 47, mentioned later, of the cap cylinder 41. The cap cylinder 41 has a discharge opening 44 with which the applicator 61 is connected, and it holds the inside plug 12 and the valve body 14 between the cap cylinder 41 and the opening portion 24 of the container main body 11 in a state that they are screwed into the opening portion 24 of the container main body 11. Moreover, the lower end inner circumferential portion is jointed to the fitting shoulder portion 26 of the opening portion 24 of the container main body 11 so that the introduced air does not leak out of the container main body 11, and the air inlet passage 45 is formed between the cap cylinder 41 and the outer circumferential surface of the opening portion 24. The cap cylinder 41 has an intake opening 46 which can be sealed by an intake valve 52 of the valve body 14.

The valve body 14 is held to the cap cylinder 41 of the cap 13 in a state that the inside plug 12 is fitted to the valve body 14, and has a discharge valve (check valve) 51, which opens the discharge passage 31 of the inside plug 12 only in a content discharge direction so as to be capable of discharging the content from the discharge opening 44 and an intake valve (check valve) 52 which opens the intake opening 46 of the cap 13 only in an air introducing direction so as to be capable of introducing air from the intake passage 32, the air inlet passage 45 and the air introducing hole 27 between the outer layer 21 and the inner layer 22.

The applicator 61 is fitted to the mounting portion 47 provided around the discharge opening 44 of the cap cylinder 41 composing the cap 13 of the container main body 11. Here, it is not limited that the applicator 61 is fitted to the mounting portion 47, and thus the applicator 61 is screwed thereinto so as to be capable of being freely removed therefrom.

Therefore, since applicators such as a comb and a brush can be freely replaced according to an applying object, an applying efficiency and an objective portion to be applied, after the applying agent is consumed, the applicator 61 can be reused and need not be thrown away. The applicator 61 is composed of a comb main body 62 and a comb tooth body 63. The comb main body 62 includes an insertion portion 62A which is inserted into the mounting portion 47 of the cap cylinder 41, an implanting portion 62B where the comb tooth body 63 is implanted, and a liquid flow passage 62C which is connected with the discharge opening 44 of the cap cylinder 41 and is continued from the insertion portion 62A to the implanting portion 62B. The comb tooth body 63, which has a lot of comb teeth 63A is implanted into the implanting portion 62B of the comb main body 62. The comb tooth body 63 has a liquid outlet passage 63B which is connected with the liquid flow passage 62C of the comb main body 62 and is provided across root portions of the respective comb teeth 63A and the middle portions. The liquid outlet passage 63B is opened to comb teeth surfaces in substantially middle portions of the respective comb teeth 63A.

Therefore, the applying agent flows out of the squeeze container 10 with the applicator and air is inhaled to an area between the outer layer 21 and the inner layer 22 as follows.

(1) When the container main body 11 is squeezed, the discharge valve 51 is opened due to rise of the inner pressure, and the applying agent as a content of the container main body 11 is discharged from the discharge opening 44, and the applying agent passes through the liquid flow passage 62C and the liquid outlet passage 63B of the applicator 61 so as to flow onto the comb tooth surfaces of the comb teeth 63A of the comb tooth body 63.

(2) When the squeezing of the container main body 11 is released, an internal pressure of the container is reduced to become a negative pressure by a restoring force of the outer layer 21, and the discharge valve 51 is closed and an inter-layer between the inner 22 and outer 21 layers obtains a negative pressure. Then, the intake valve 52 is opened via the air introducing hole 27 of the outer layer 21, the air inlet passage 45 and the intake passage 32, and air is introduced into the inter-layer from the intake opening 46 via the intake passage 32, the air inlet passage 45 and the air introducing hole 27, and while the outer layer 21 is being restored, the peeling of the inner layer 22 proceeds.

(3) Next, when the container main body 11 is squeezed, the intake valve 52 is in a non-return state so as to be closed, and an internal pressure of the container rises by pressurized air in the inter-layer, and the discharge valve 51 is opened so that the content is discharged from the discharge opening 44. As a result, similarly to (1), the content flows to the comb tooth surfaces of the comb teeth 63A of the comb tooth body 63.

(4) When the squeeze of the container main body 11 is released, the internal pressure in the container is reduced so as to become a negative pressure by the restoring force of the outer layer 21, and the discharge valve 51 is closed and the intake valve 52 is opened so that air is introduced into the inter-layer.

The applicator is not limited to the comb, and thus a brush or the like may be used.

Moreover, the position of the discharge opening for the agent is not limited to the substantially middle portions of the comb teeth 63A and thus the discharge opening may be provided in the comb main body portion between the comb teeth 63A and vicinities of a root or point of the comb teeth 63A.

Figure 3:
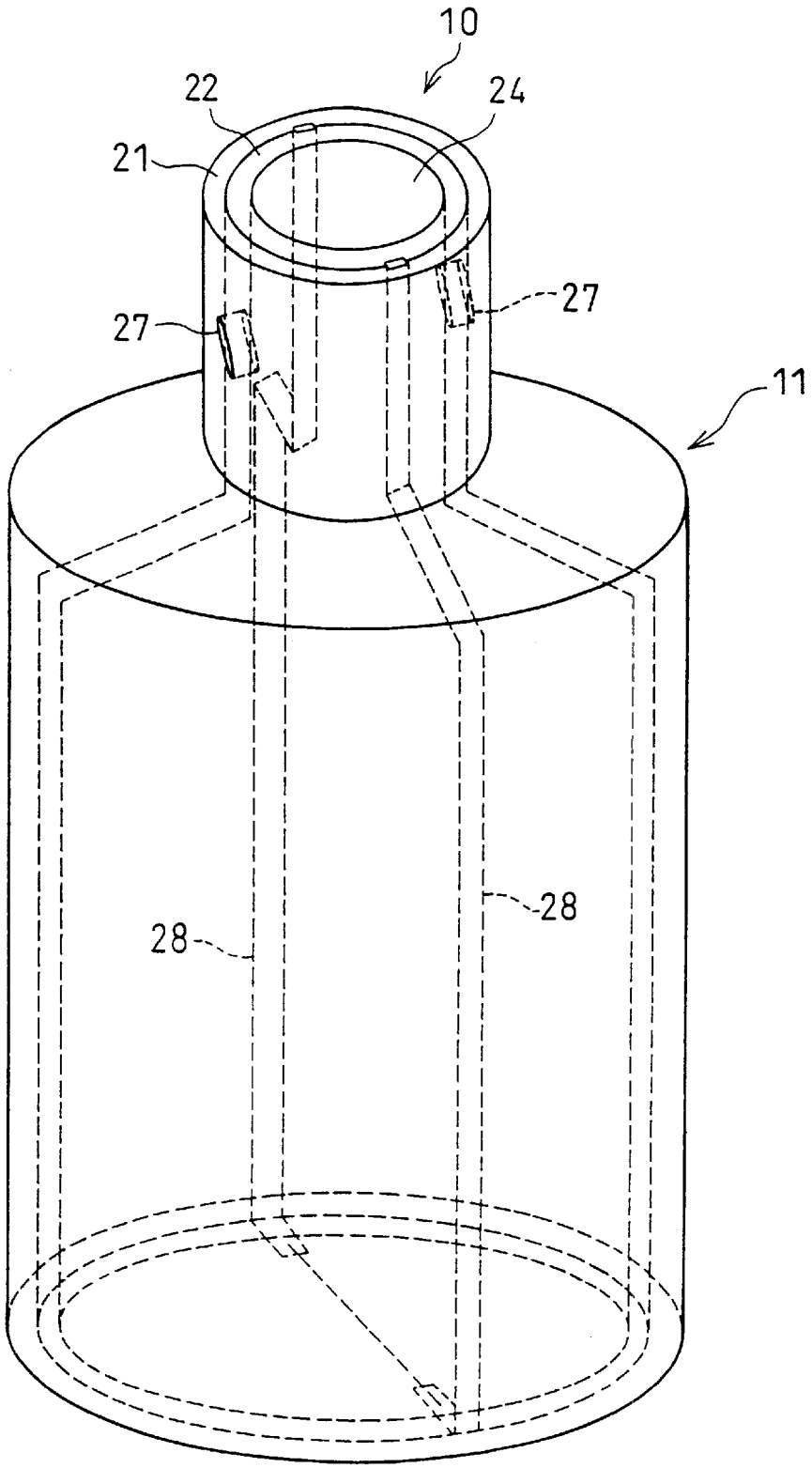
FIG. 3 is a schematic diagram showing a container main body of a squeeze container according to a first embodiment of the invention.
Figure 4:
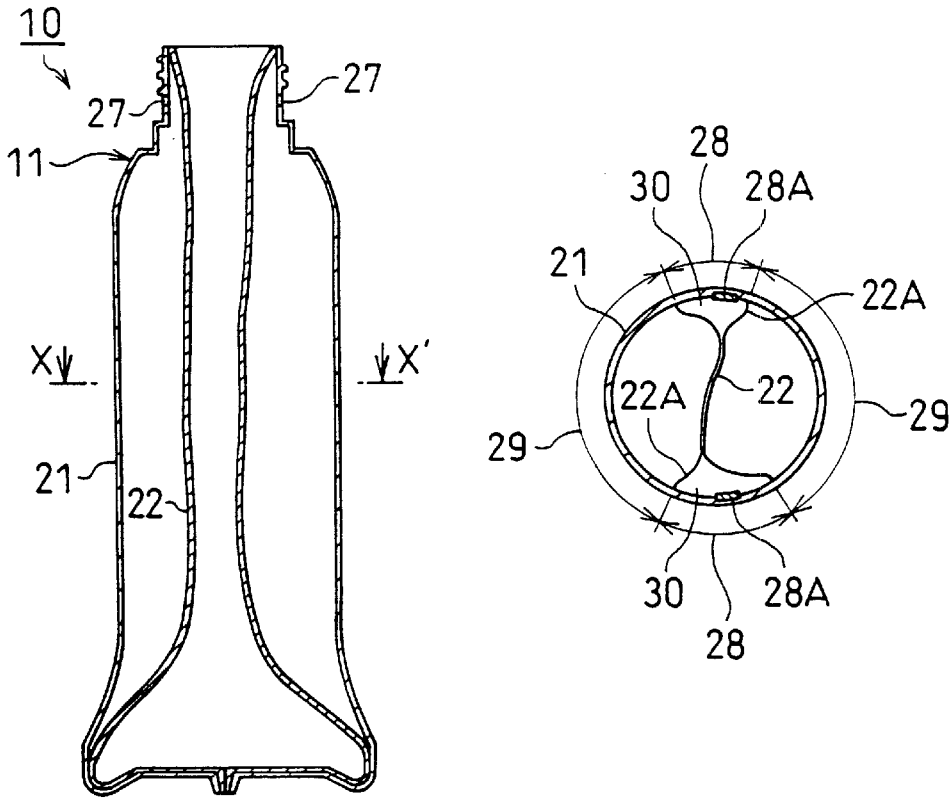
FIG. 4 is a schematic diagram showing a process of discharging an contained solution according to the first embodiment.

(First Embodiment) (FIGS. 3 and 4)

Nevertheless, the squeeze container 10 adopts the following structure in order to be capable of restoring the appearance shape of the squeezed container main body 11 smoothly and of discharging the whole content securely.

As shown in FIGS. 3 and 4, two adhesive zones 28, where the outer layer 21 is not separated from the inner layer 22 of the container main body 11, are extended in two positions in a container circumferential direction, namely, two positions of the container main body 11 in a diameter direction in the present embodiment (symmetrical two positions) from the bottom portion in a container height-wise direction towards the opening portion 24. The air introducing holes 27 are disposed on portions of the outer layer 21 corresponding to separate zones 29. Here, the adhesive zone 28 is composed of an adhesive layer 28A provided between the outer layer 21 and the inner layer 22 so as to cover the whole height range of the container main body 11 corresponding to a whole length where the laminated parison 23 is pushed out.

Then, passages (liquid passages) 30 for the content can be formed between the inner layer 22 which is separated from the outer layer 21 of the container main body 11 and the adhesive zones 28. The passages 30 are formed by the following method (A) and/or (B).

(A) A width of the adhesive zone 28 along the container circumferential direction is set or the like, and constant curvature is secured at base portions 22A of the inner layer 22 separated from the outer layer 21 in a side of the adhesive zones 28 so that the passages 30 are formed respectively at the base portions 22A.

(B) A sum of the lengths of the separate zones <[(2×a distance between the facing adhesive zones 28, 28)+a sum of the lengths of the adhesive zones]. According to this equation, the constant passages 30 (gaps) are always formed between the facing inner layers 22 of the facing separate zones 29 even when the inner layers 22 are the closest to each other.

Here, in the container main body 11, at least one of the inner circumferential surface of the outer layer 21 provided with the air introducing hole 27 and the outer circumferential surface of the inner layer 22 facing the air introducing hole 27 is formed into a concave shape or the like so that an air introducing gap which is connected with the air introducing hole 27 is disposed on the inner circumferential surface of the outer layer 21 and/or the outer circumferential surface of the inner layer 22. As a result, the air can be securely introduced from the air introducing hole 27 into the gap between the outer layer 21 and the inner layer 22.

At this time, in the present invention, in the case of a lamination peeling container, when high-density polyethylene, low-density polyethylene, polypropylene or the like is used, for example, as the material of the outer layer 21, nylon, eval, PET or the like is used as the material of the inner layer 22. When nylon, eval, PET or the like is used as the material of the outer layer 21, high-density polyethylene, low-density polyethylene, polypropylene or the like is used as the material of the inner layer 22. Adhesive polyolefin (product name: ADMER or the like) which can bond the outer layer 21 to the inner layer 22 is used as resin of the adhesive layer. Moreover, the container main body may be separated into an outer container and an inner container and combine them. For example, polyethylene, polypropylene or the like is used so that the outer container is blow-formed, and the inner container is formed by a film of polyethylene, polypropylene or the like, and the adhesive zone can be made by thermal solvent welding or adhesive agent.

Therefore, the present embodiment produces the following effects (1)–(4) as shown in FIG. 4.

(1) The inner layer 22, which is separated from the outer layer 21 in the height-wise direction of the squeeze container 10, forms the passages 30 for the content between the inner layer 22 and the adhesive zones 28. For this reason, in the process of squeezing the container main body 11 so as to discharge the content and shrink the inner layer 22, the facing upper portions of the inner layers 22 in the container height-wise direction do not bond to each other in the whole area of the cross section prior to the lower portions, and thus the content passes through the passages 30 so as to securely flow from the lower position to the discharge opening 44 in the upper position.

(2) Since the adhesive zones 28 of the outer layer 21 and the inner layer 22 are provided on one portion in the container circumferential direction, when the outer layer 21 is restored after the content is discharged by the squeeze of the container main body 11, the inner layer 22 can be surely separated from the outer layer 21 in the whole area in the container height-wise direction, and thus the restoration of the outer layer 21 is not hindered. Therefore, in combination with (1), the appearance shape of the squeezed container 10 can be restored smoothly, and simultaneously the whole content can be discharged completely and securely.

(3) The two adhesive zones 28 of the outer layer 21 and the inner layer 22 are provided and the air introducing holes 27 are disposed correspondingly on the separate zones 29 which are sandwiched between the adjacent adhesive zones 28, 28. As a result, the facing inner layers 22 are separated from the outer layer 21 so as to be shrunk symmetrically with respect to a line so that the passages 30 for the content can be formed stably between the inner layers 22 and the adhesive zones 28.

(4) The air introducing gap is previously formed between the outer layer 21 and the inner layer 22 connected with the air introducing hole 27. Therefore, air is introduced simultaneously from the air introducing holes 27 corresponding to both the separate zones 29 in (3) into the separate zones 29, and the facing inner layers 22 are started to be separated from the outer layer 21 securely so as to be capable of being shrunk stably and securely and symmetrically with respect to the line.

Figure 5:
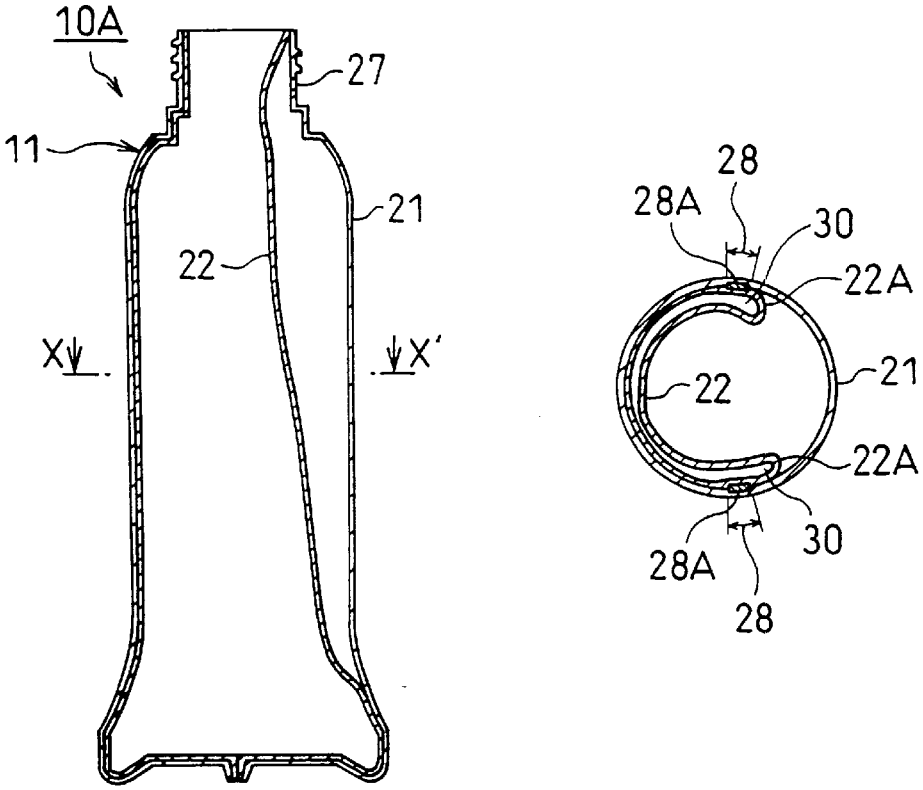
FIG. 5 is a schematic diagram showing a process of discharging a contained solution according to a second embodiment of the invention.

(Second Embodiment) (FIG. 5)

A different point of a squeeze container 10A of the second embodiment with the lamination peeling container 10 of the first embodiment is that the air introducing hole 27 is provided only on the outer layer 21 corresponding to the one separate zone 29 sandwiched by the adjacent adhesive zones 28. In this squeeze container 10A, when the content is discharged by the squeeze of the container main body 11, only the inner layer 22 on the side of the separate zone 29 on which the air introducing hole 27 is provided of the facing inner layers 22, 22 is separated from the outer layer 21, and the separated inner layer 22 is converted from the base portions 22A with respect to both the adhesive zones 28 so as to be shrunk into a U shape (FIG. 5). Also in this squeeze container 10A, the width of the adhesive zone 28 along the container circumferential direction is set or the like and constant curvature is secured at the base portion 22A of the inner layer 22 separated from the outer layer 21 in the side of the adhesive zone 28. As a result, the passage 30 is formed at the base portions 22A so that the appearance shape of the squeezed container 10A can be restored smoothly and at the same time the whole content can be discharged completely and securely.

In the embodiments of the present invention, in the container main body 11, a length of the separate zone 29 in the container circumferential direction where the outer layer 21 is separated from the inner layer 22 can be set to be smaller than a length of the half circumference of the container. Namely, as a result, even in the case where only one wide adhesive zone 28 is provided in the container circumferential direction, it can be avoided that the upper portions of the facing inner layers 22 in the container height-wise direction bond to each other in the whole area of the cross-section earlier than the lower portions.

In addition, in the embodiments of the present invention, three or more adhesive zones 28 may be provided. Further, at this time, the air introducing hole 27 may be provided correspondingly to the separate zones 29 sandwiched by the adjacent adhesive zones 28 of the three or more adhesive zones 28.

In addition, in the embodiments of the present invention, the adhesive zone 28 is formed over the whole area of the height-wise direction of the squeeze container 10, but not only a continuous adhesive zone but also a discontinuous adhesive zone may be used.

In addition, the squeeze container according to the present invention with an agent applicator is constituted so that, for example, an inside of a handgrip of the applicator such as a comb and a brush is connected with the discharge opening of the squeeze container, and its content passes from the squeeze container through the inside of the handgrip of the applicator so as to be capable of being discharged and held and applied onto comb teeth, spaces between the comb teeth or the like.

According to the present invention, in the container with applicator, applying agent can be discharged in any posture of the container, and if a residual amount of the applying agent becomes small, dispersion of the applying agent due to inclusion of air can be prevented.

In addition, in a squeeze container, the appearance shape of the squeezed container can be restored smoothly, and its content can be discharged completely and securely.

What is claimed is:

1. A squeeze container with an applicator, comprising:

a container main body composed of a flexible outer layer and an inner layer laminated on said outer layer and configured to be freely peeled from said outer layer;

at least one air introducing hole on said outer layer;

a discharge opening connected with said inner layer;

an air intake valve mounted at an upper side of said air introducing hole, which closes when said container main body is squeezed, and opens when the squeezing is released;

an applicator connected with said discharge opening of said container main body; and at least one adhesive zone configured to secure said outer layer to said inner layer at said at least one adhesive zone and configured to extend in a container circumferential direction in a container heigh-wise direction, wherein a passage for the content of said container is formed between said inner layer separated from said outer layer and said adhesive zone, wherein a length of a separate zone where said outer layer is separated from the inner layer in the container circumferential direction is configured to be smaller than a length of a container half circumference, wherein two adhesive zones are provided, and said air introducing hole is provided correspondingly to respective of two separate zones, and wherein said adhesive zones are provided correspondingly to respective two positions facing each other on a diameter through a center of the container.

2. A squeeze container with an applicator according to claim 1, further comprising air introducing gaps formed between said outer layer and said inner layer which are connected with said air introducing holes.

3. A squeeze container with an applicator according to claim 1, further comprising a unitary valve body including said air intake valve and a discharge valve mounted within said discharge opening, which opens when said container main body is squeezed, and closes when the squeezing is released.

4. A container with an applicator, comprising:

a container main body including a flexible outer layer and an inner layer laminated on said outer layer and configured to be freely peeled from said outer layer;

at least one air introducing hole on said outer layer;

a discharge opening connected with said inner layer;

a discharge valve mounted within said discharge opening, which opens when said container main body is squeezed, and closes when the squeezing is released;

an applicator connected with said discharge opening of said container main body; and at least one adhesive zone configured to secure said outer layer to said inner layer at said at least one adhesive zone and configured to extend in a container circumferential direction in a container heigh-wise direction, wherein a passage for the content of said container is formed between said inner layer separated from said outer layer and said adhesive zone, wherein a length of a separate zone where said outer layer is separated from the inner layer in the container circumferential direction is configured to be smaller than a length of a container half circumference, wherein two adhesive zones are provided, and said air introducing hole is provided correspondingly to respective of two separate zones, and wherein said adhesive zones are provided correspondingly to respective two positions facing each other on a diameter through a center of the container.

5. A container with an applicator according to claim 4, further comprising air introducing gaps formed between said outer layer and said inner layer which are connected with said air introducing holes.

6. A container with an applicator, comprising:

a container main body including a flexible outer layer and an inner layer laminated on said outer layer and configured to be freely peeled from said outer layer;

at least one air introducing hole on said outer layer;

a discharge opening connected with said inner layer;

a discharge valve mounted within said discharge opening, which opens when said container main body is squeezed, and closes when the squeezing is released;

an applicator connected with said discharge opening of said container main body; and exactly two adhesive zones configured to secure said outer layer to said inner layer and configured to extend in a container circumferential direction in a container heigh-wise direction, wherein a first passage for the content of said container is formed between said inner layer separated from said outer layer and one of said two adhesive zones, and wherein a second passage for the content of said container is formed between said inner layer separated from said outer layer and another of said two adhesive zones.

7. A container with an applicator according to claim 6, wherein a length of a separate zone where said outer layer is separated from the inner layer in the container circumferential direction is configured to be smaller than a length of a container half circumference.

8. A container with an applicator according to claim 6, wherein said air introducing hole is provided correspondingly to said two adhesive zones.

* * * * *